US007748329B2

(12) United States Patent
Baltz

(10) Patent No.: US 7,748,329 B2
(45) Date of Patent: Jul. 6, 2010

(54) PALLET ASSEMBLY

(75) Inventor: Kyle L. Baltz, Redondo Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 210 days.

(21) Appl. No.: 11/491,835

(22) Filed: Jul. 24, 2006

(65) Prior Publication Data

US 2008/0017081 A1 Jan. 24, 2008

(51) Int. Cl.
*B65D 19/12* (2006.01)

(52) U.S. Cl. ..... 108/56.1; 108/57.25

(58) Field of Classification Search ..... 108/57.25, 108/57.28, 27, 51.11; 403/286, 294, 240, 403/263

See application file for complete search history.

(56) References Cited

U.S. PATENT DOCUMENTS

| | | | | | |
|---|---|---|---|---|---|
| 2,651,486 | A | * | 9/1953 | Woodward | 108/57.1 |
| 2,817,485 | A | | 12/1957 | White et al. | |
| 4,550,830 | A | | 11/1985 | Shuert | |
| 4,715,294 | A | * | 12/1987 | Depew | 108/57.17 |
| 4,735,331 | A | | 4/1988 | Keenan et al. | |
| 4,775,068 | A | | 10/1988 | Reiland et al. | |
| 4,917,255 | A | | 4/1990 | Foy et al. | |
| 5,076,175 | A | | 12/1991 | Whatley, II | |
| 5,094,356 | A | | 3/1992 | Miller | |
| 5,330,066 | A | * | 7/1994 | Carroll | 211/189 |
| 5,413,052 | A | * | 5/1995 | Breezer et al. | 108/56.1 |
| 5,586,675 | A | | 12/1996 | Borsboom et al. | |
| 5,673,629 | A | * | 10/1997 | Ginnow | 108/57.17 |
| D398,732 | S | * | 9/1998 | Pigott et al. | D34/38 |
| 6,109,190 | A | * | 8/2000 | Hale et al. | 108/57.25 |
| 6,142,329 | A | | 11/2000 | Dotan | |
| 6,216,608 | B1 | * | 4/2001 | Woods et al. | 108/57.25 |
| 6,622,641 | B2 | * | 9/2003 | Smyers | 108/56.1 |
| 6,766,749 | B2 | * | 7/2004 | Lacabanne | 108/56.3 |
| 6,840,181 | B2 | * | 1/2005 | Smyers | 108/56.1 |
| 6,878,025 | B2 | * | 4/2005 | Mead | 441/74 |
| 6,966,449 | B2 | | 11/2005 | Williams | |
| 7,543,539 | B2 | | 6/2009 | Miller | |
| 2003/0090182 | A1 | * | 5/2003 | Johnson | 312/265.5 |
| 2004/0216648 | A1 | * | 11/2004 | Apps et al. | 108/57.25 |

OTHER PUBLICATIONS

UK Search Report for UK Application No. 0714154.2, Oct. 1, 2007.

* cited by examiner

*Primary Examiner*—José V. Chen
*Assistant Examiner*—Matthew W Ing
(74) *Attorney, Agent, or Firm*—Carlson, Gaskey & Olds

(57) ABSTRACT

A pallet assembly includes an upper deck and a plurality of supports extending downward from the upper deck. A cap is secured in front of at least one of the supports to protect the support. The cap may be formed of a material different from the support, such as a higher density, tougher or harder material without increasing the cost of the materials for the supports and deck.

22 Claims, 9 Drawing Sheets

PALLET ASSEMBLY

BACKGROUND OF THE INVENTION

This invention relates generally to a pallet assembly.

Pallets are often used to store and transport goods. Pallets maintain the goods at a distance above the floor such that they can readily be lifted and moved by a forklift. Plastic pallets are lighter and more durable than wooden pallets.

Some pallets comprise upper and lower decks separated by a plurality of columns that maintain the space between the upper and lower decks. Other pallets include only an upper deck supported by a plurality of columns. In either case, forklift operators sometimes move the loaded and stacked pallets by pushing on one of columns with one of the fork tines of the forklift. This may eventually damage the outer wall of the column. The damage is usually cosmetic, not structural; however, the appearance of the damaged column may lead some to believe that the structure of the pallet has been compromised and that the pallet needs to be replaced prematurely.

SUMMARY OF THE INVENTION

The present invention provides a pallet assembly including an upper deck and a plurality of supports extending downward from the upper deck. A cap is secured in front of at least one of the supports to protect the support. The cap may be formed of a material different from the support, such as a higher density, tougher or harder material, without increasing the cost of the materials for the supports and deck. Optionally, whether or not made of tougher material, the cap can be replaceable if damaged.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
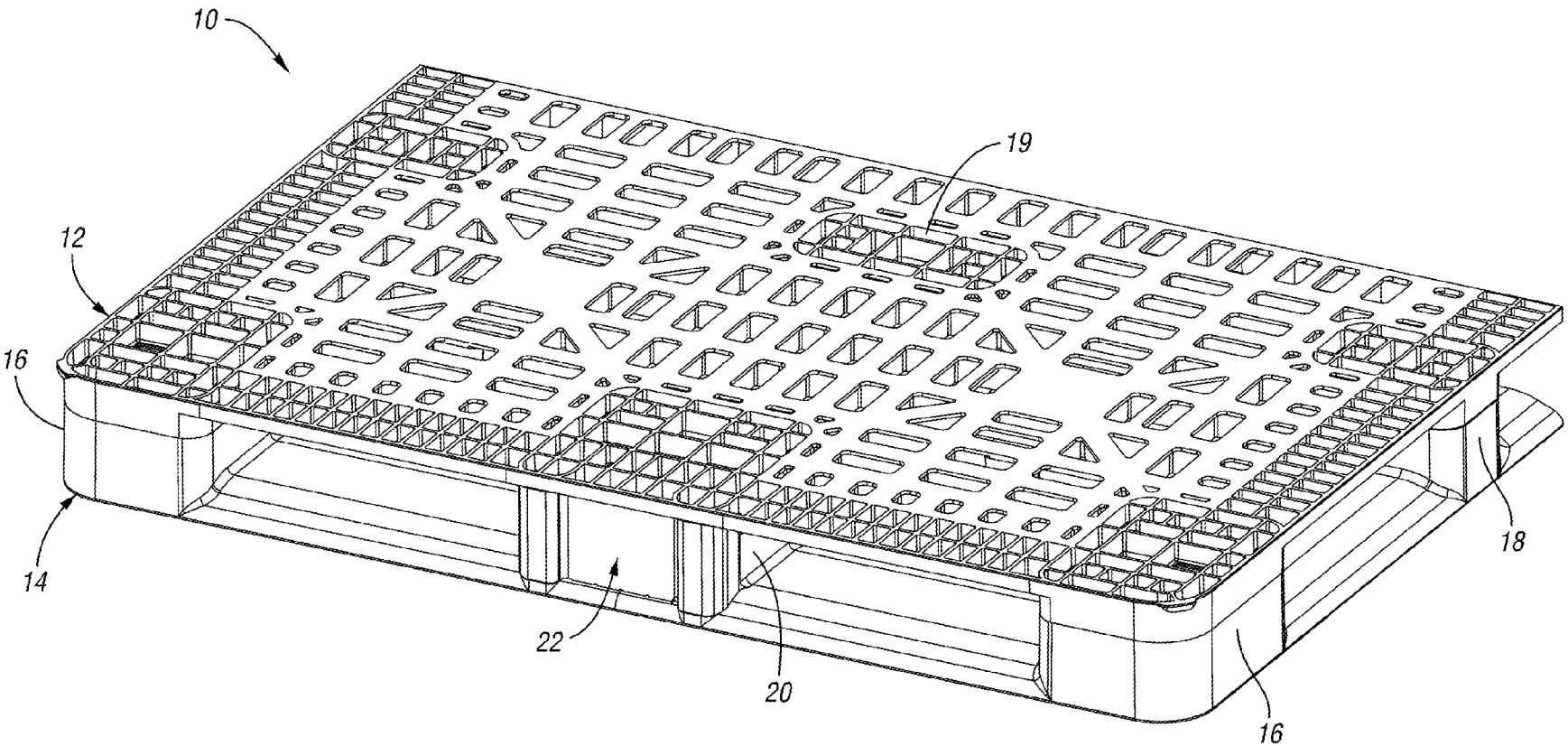
FIG. 1 is a perspective view of half of a pallet according to one embodiment of the present invention.

A half perspective view of an example pallet 10 constructed according to the present invention is shown in FIG. 1. Although only half is shown for simplicity, it is understood that the other half would be similar. The pallet 10 includes an upper deck 12 spaced above a lower deck 14 by a plurality of supports or columns including corner columns 16, side columns 18, a center column 19 and end columns 20. The upper deck 12 and the lower deck 14 in this example are each a single, integrally formed part, such as by injection molding polypropylene or other suitable material. Other methods such as rotomolding or thermoforming may also be used.

A column cap 22 is separately formed of a higher density material, such as a higher density polymer such as a high molecular weight high density polyethylene, such that it is stiffer and tougher than the end column 20 (i.e. than the upper deck 12 and lower deck 14), which may be polypropylene or polyethylene. The column cap 22 may be injection molded (if polymer) or formed according to any suitable process. In the example shown, the column cap 22 is fitted in front of only the end column 20 (and the opposite end column 20, not shown), as this is the column most often impacted by the tines of the forklift; however, additional column caps 22 could be fitted over any or all of the remaining columns as well.

Figure 2:
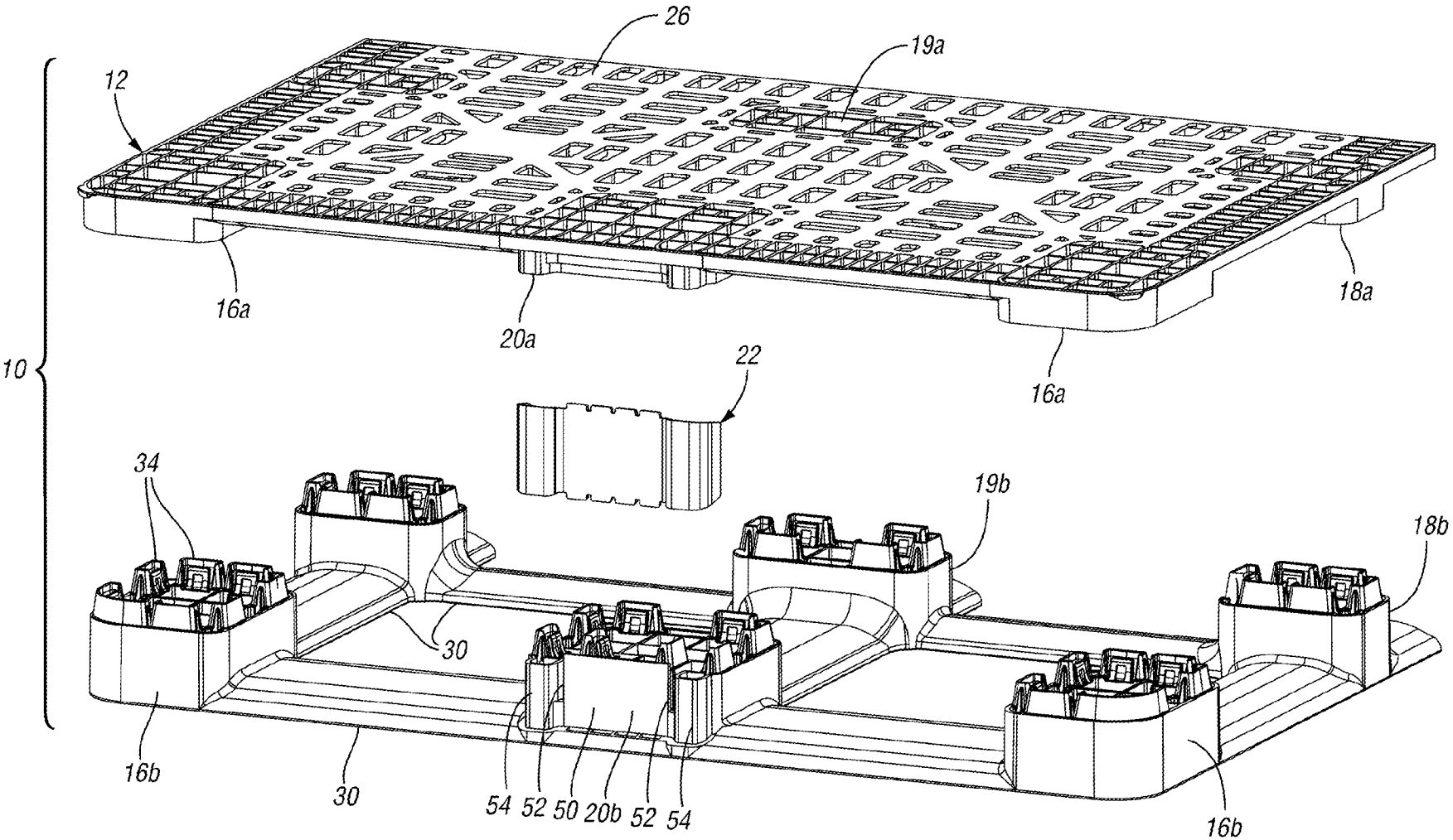
FIG. 2 is an exploded view of the half of the pallet of FIG. 1.

FIG. 2 is an exploded view of the pallet 10 of FIG. 1. The upper deck 12 includes a plurality of integrally molded upper column portions 16*a*, 18*a*, 19*a*, 20*a* that together with integrally molded lower column portions 16*b*, 18*b*, 19*b* 20*b*, form the corner columns 16, side columns 18, center column 19 and end columns 20, respectively. The lower deck 14, as shown in this example, may include a plurality of runners 30 that interconnect the plurality of lower column portions 16*b*, 18*b*, 19*b*, 20*b*. The end column lower portion 20*b* includes a front wall 50 having gaps 52 on either side of the front wall 50 between the front wall 50 and each of a pair of pillars 54 that protrude outward relative to the front wall 50. The lower column portions 16*b*, 18*b*, 19*b*, 20*b* each include snap-fit connectors 34 for securing to complementary connectors on the corresponding upper column portions. Numerous other known ways of connecting the upper and lower decks 12, 14 can be used, such as heat staking, vibration welding, etc.

Figure 3:
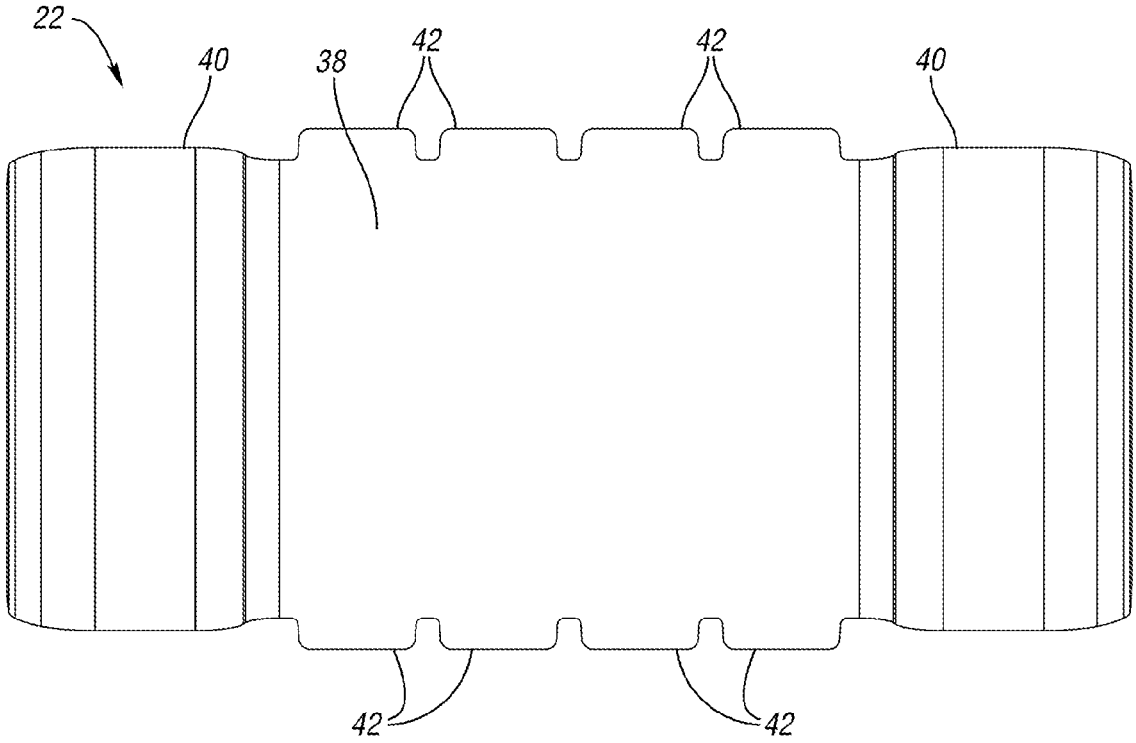
FIG. 3 is a front view of the cap of FIG. 2.

FIG. 3 is a front view of the column cap 22 of FIG. 2. The column cap 22 includes a generally flat front panel 38 and curved side walls 40. A plurality of teeth or tabs 42 project from the upper edge and from the lower edge of the front panel 38.

Figure 4:
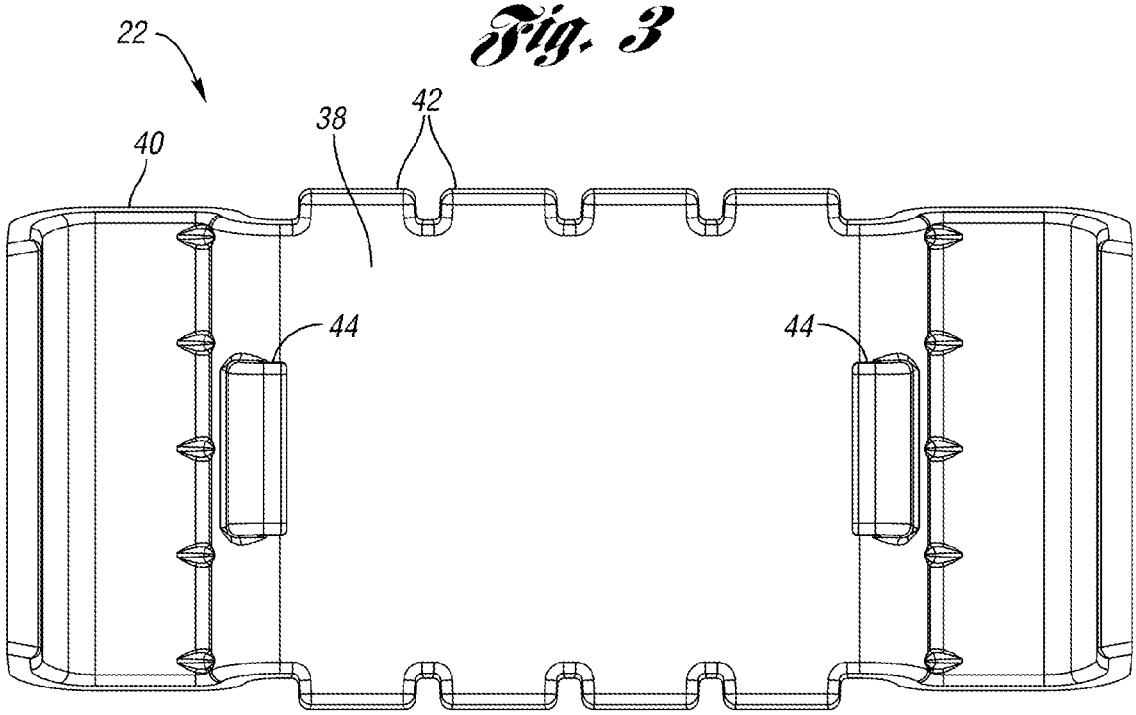
FIG. 4 is a rear view of the cap.
Figure 5:
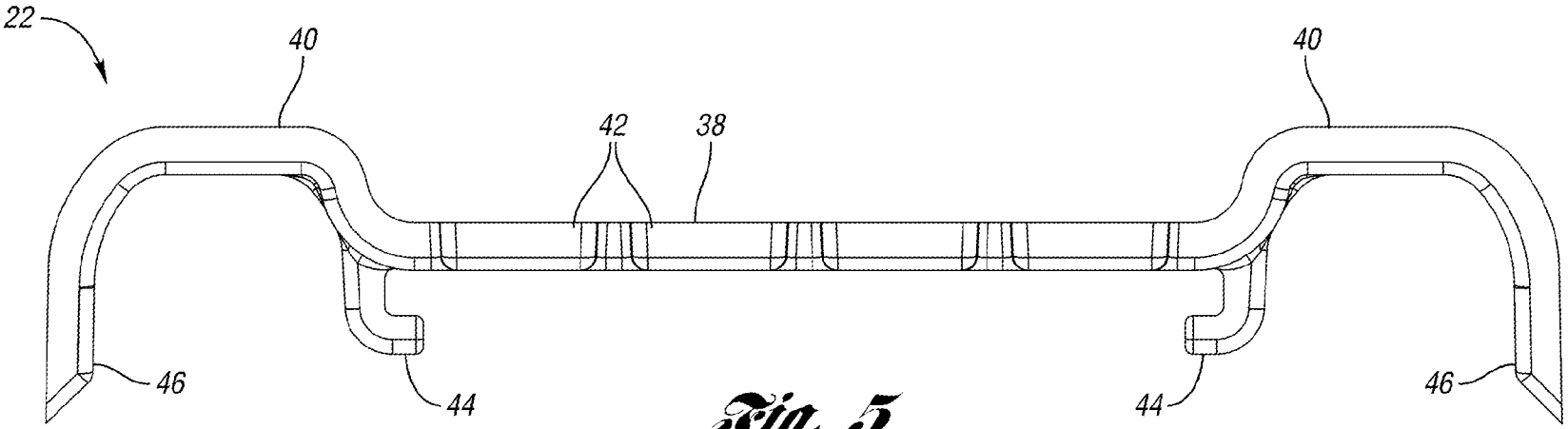
FIG. 5 is a top view of the cap.

FIG. 4 is a rear view of the column cap 22. A pair of integrally-molded hooks 44 project rearward and then inward from outer edges of the front panel 38. As shown in FIG. 5, the hooks 44 open inward toward one another. The curved side walls 40 project forward of the front panel 38 and open rearward.

Figure 6:
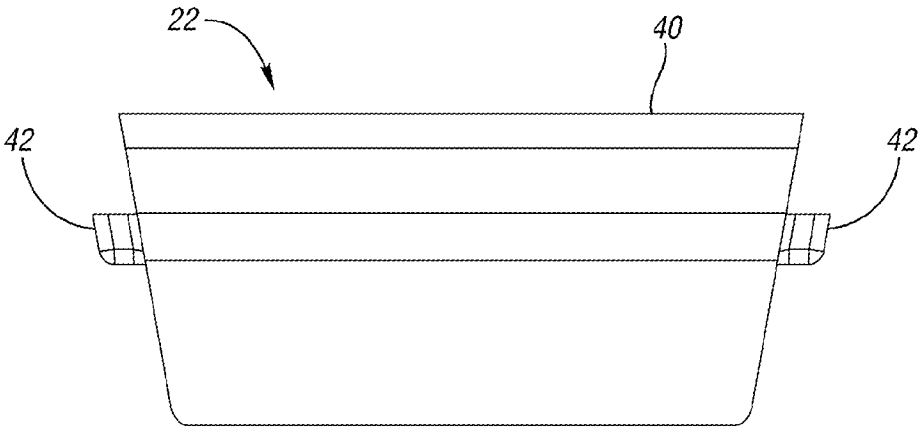
FIG. 6 is a side view of the cap.

As shown in FIG. 6, the tabs 42 protrude upward and downward further than the curved side walls 40. Also, the curved side walls 40 taper inward as they extend away from the front panel 38.

Figure 7:
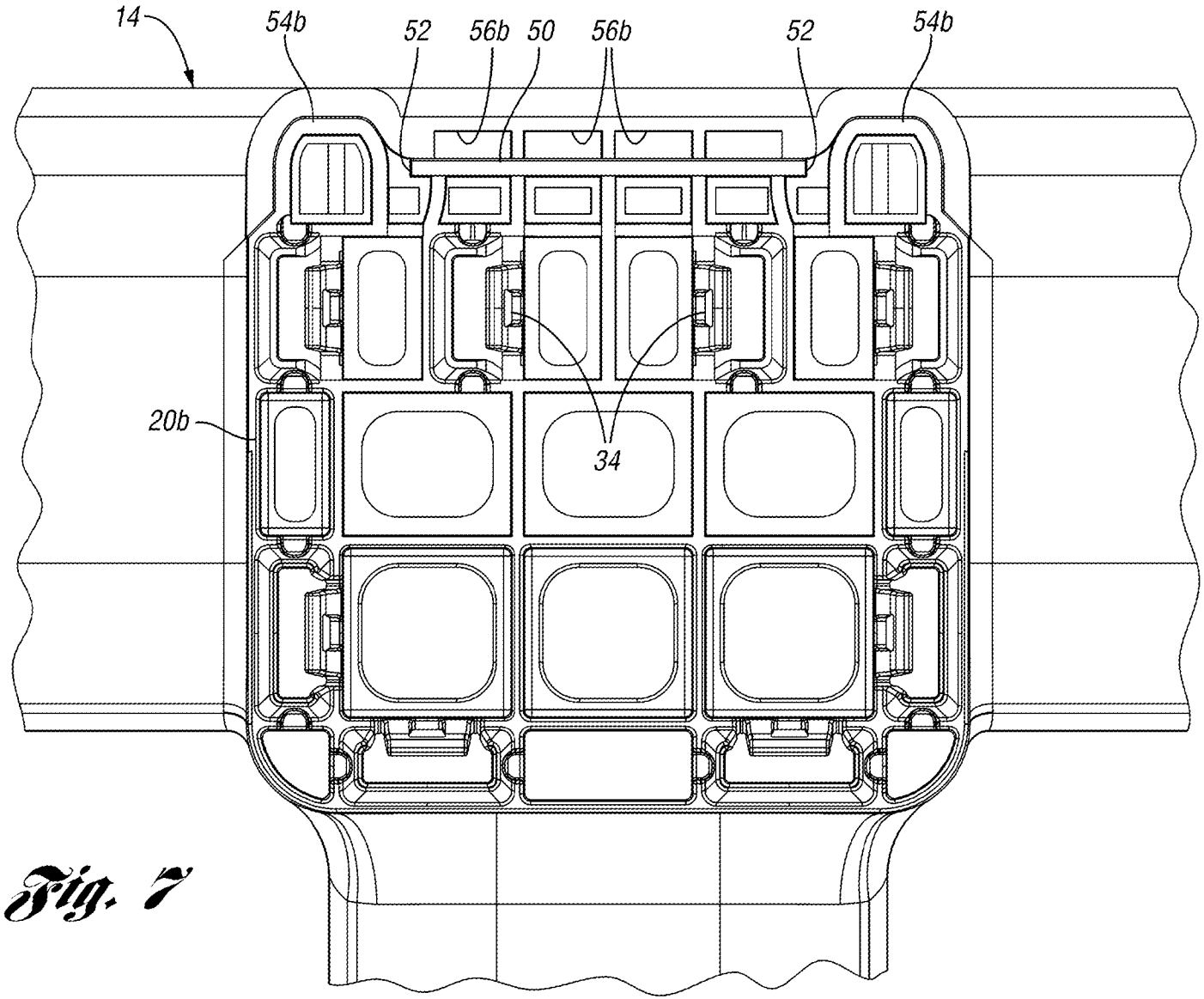
FIG. 7 is a top view of the center, end column portion of the bottom deck of FIG. 1.

FIG. 7 is a top view of the end lower column portion 20*b* of the lower deck 14 (with the column cap 22 removed). The end lower column portion 20*b* includes a plurality of apertures 56*b* in front of the front wall 50 and between the pillars 54.

Figure 8:
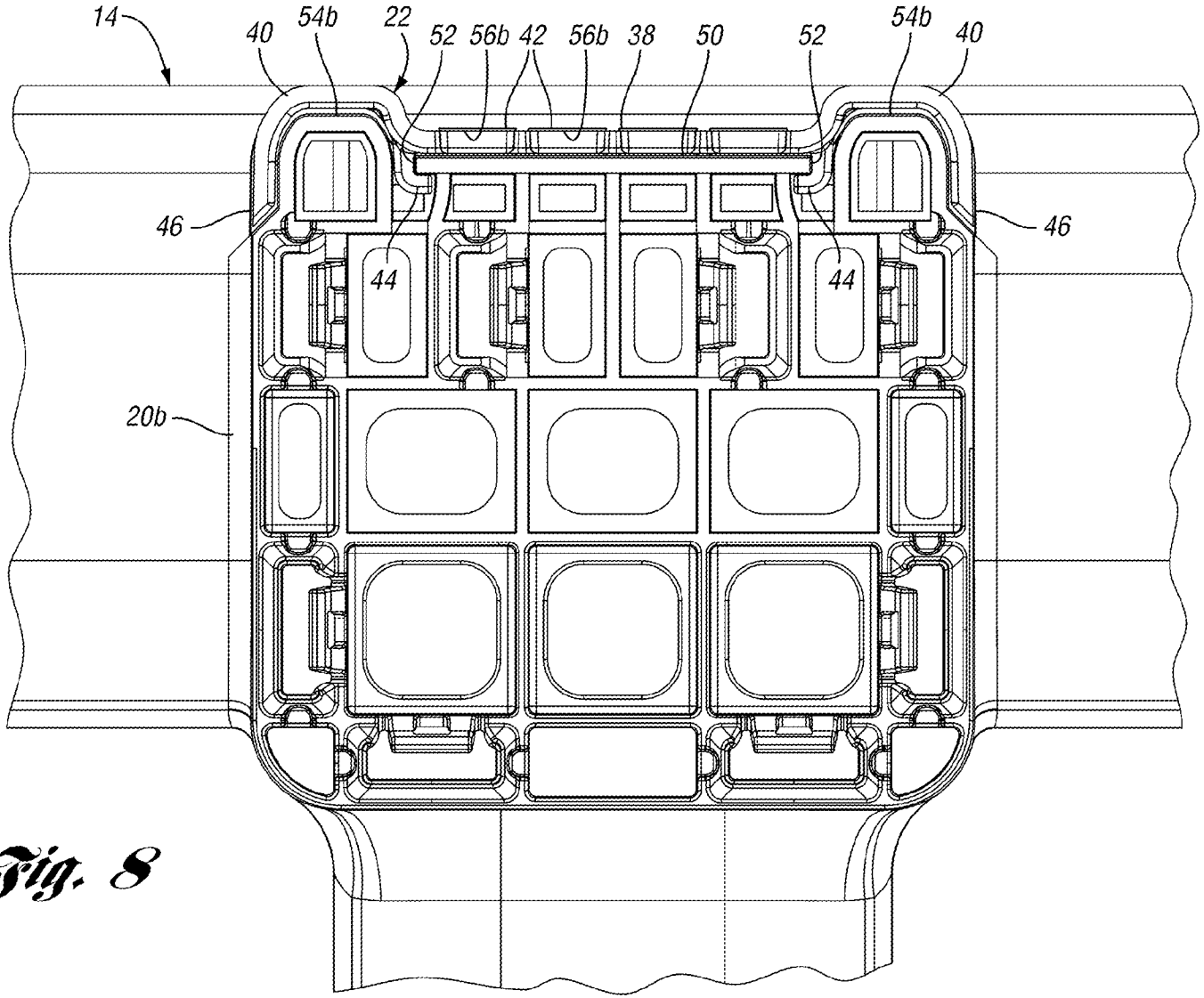
FIG. 8 is a top view of the center, end column portion of the bottom deck and the cap.

As shown in FIG. 8, to assemble the column cap 22 to the end lower column portion 20*b*, the front panel 38 of the column cap 22 is slid down in front of the front wall 50 of the end lower column portion 20*b*. The curved side walls 40 fit around the pillars 54. The hooks 44 of the column cap 22 are slid down through the gaps 52 to interlock with the front wall 50 to retain the column cap 22 to the end lower column portion 20*b*. The tabs 42 of the column cap 22 are received in the apertures 56*b* in front of the front wall 50 in the end lower column portion 20*b* to further interlock the column cap 22 with the end lower column portion 20*b*.

Figure 9:
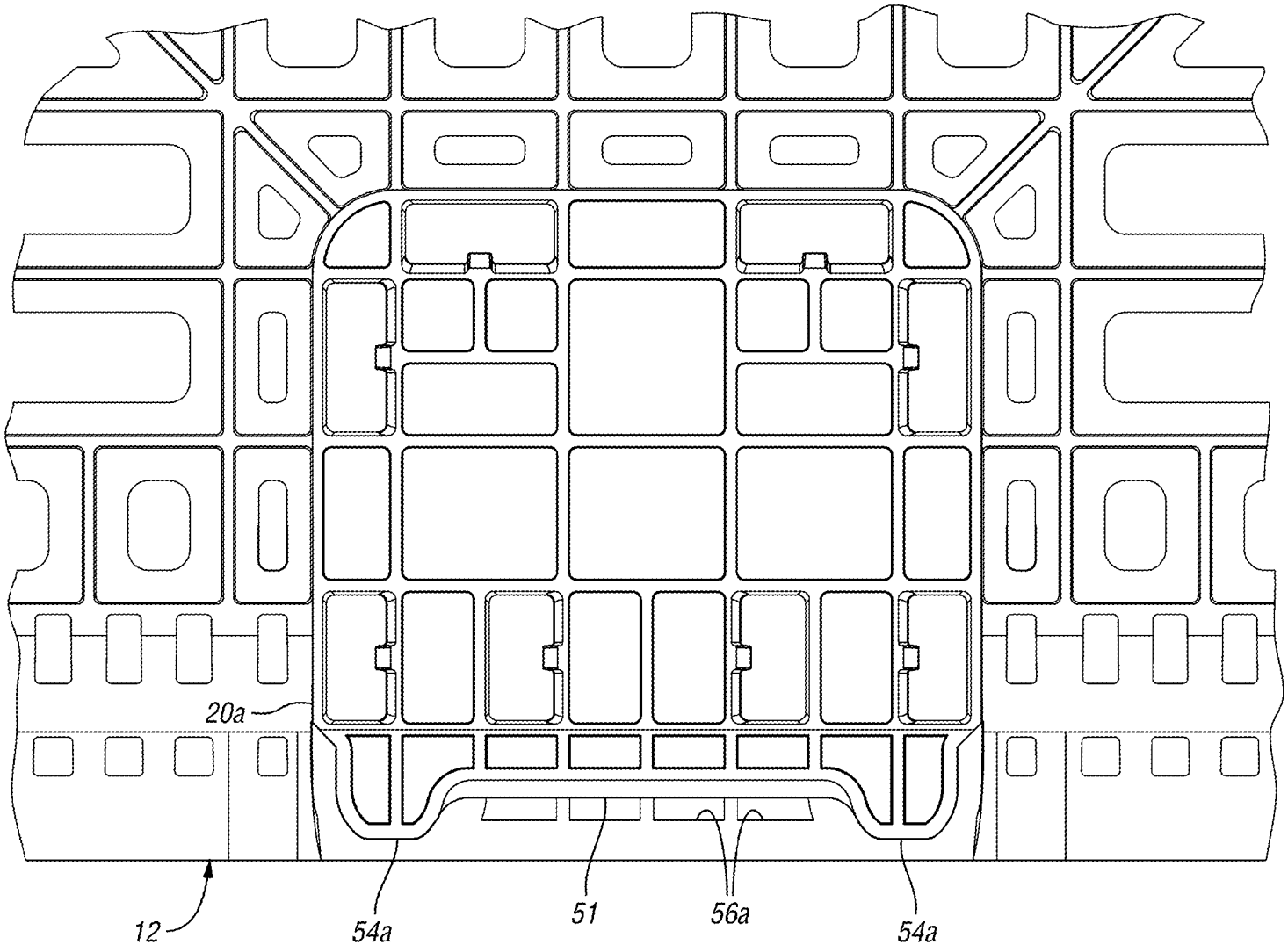
FIG. 9 is a bottom view of the center, end column portion of the top deck.
Figure 10:
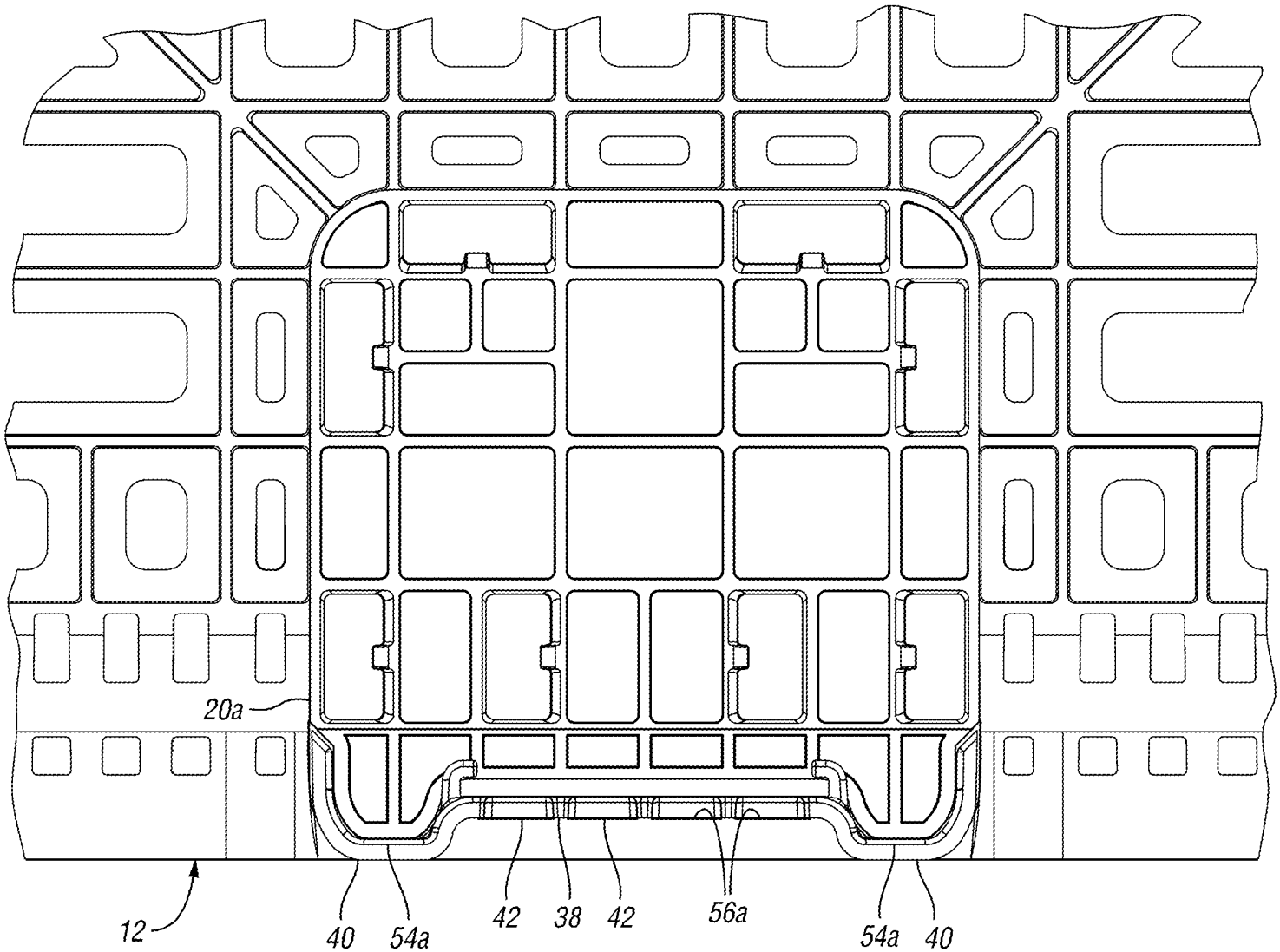
FIG. 10 is a bottom view of the center, end column portion of the top deck and the cap.

FIG. 9 is a bottom view of the end upper column portion 20*a* of the top deck 12, with the column cap 22 removed. The upper column portion 20*a* also includes a short rib forming a pair of spaced apart pillars 54*a* (much shorter than the pillars 54*b* on the lower column portion 20*b*) and a front portion 51. A plurality of spaced-apart apertures 56*a* are formed in front of the front portion 51. As shown in FIG. 10, the curved side walls 40 of the column cap 22 fit around the pillars 54*a* and the tabs 42 interlock with the apertures 56*a* to retain the column cap 22. When the upper deck 12 is assembled to the lower deck 14 (FIG. 8), the tabs 42 are so received in the apertures 56*a*.

Figure 11:
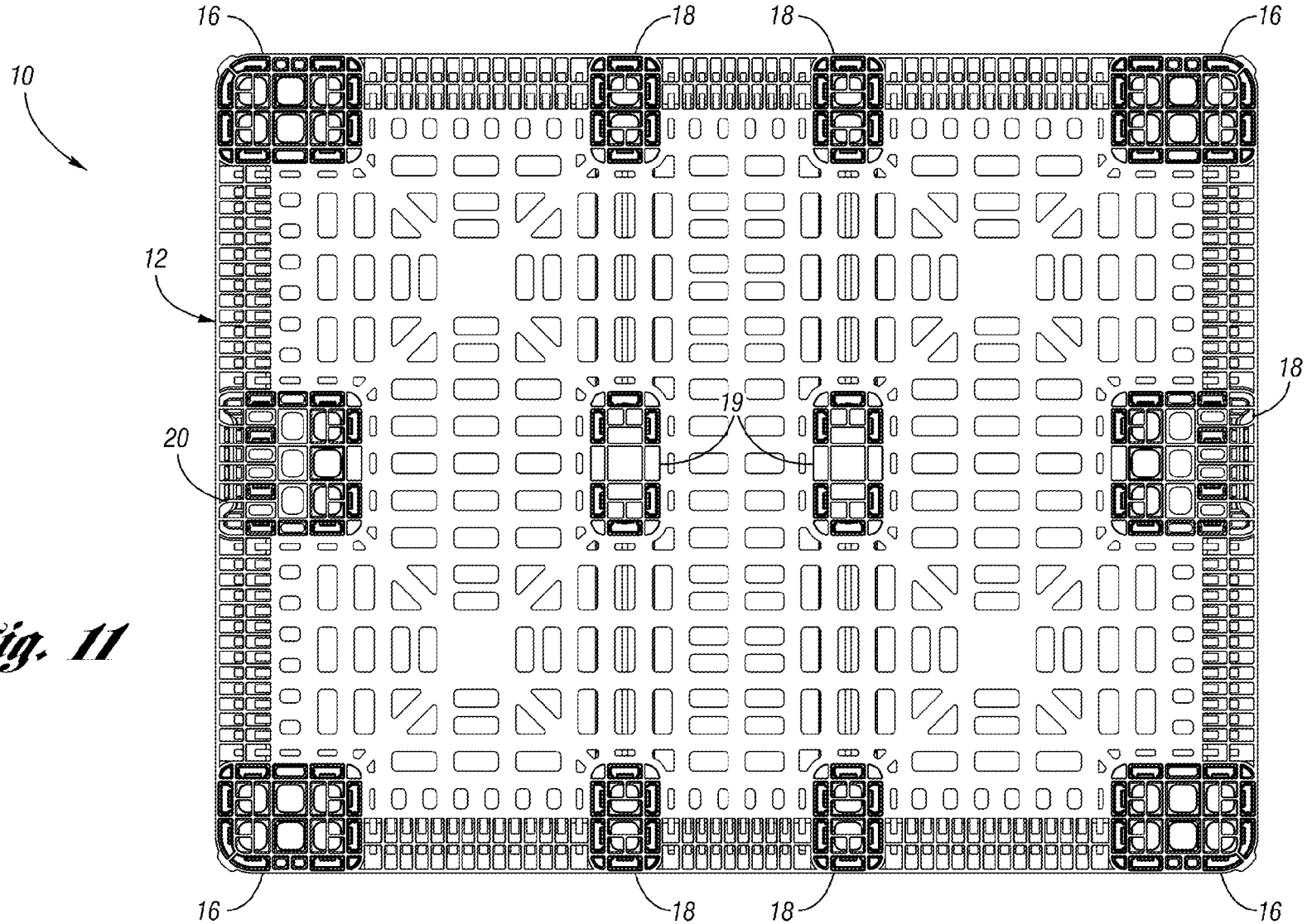
FIG. 11 is a top view of the pallet of FIG. 1.

FIG. 11 is a top view of the entire assembled pallet 10. As shown, the pallet 10 includes a similar opposite end column 20, which would also have a column cap 22.

In use, a forklift operator could push the pallet 10 across the floor by placing a tine of the fork against the column cap 22 of the end column 20. The tougher higher-density material of the column cap 22 prevents damage to the end column 20 without unnecessarily increasing the cost of materials for the entire pallet 10 or column 20. In the event that the column cap 22 does receive damage, it can easily be replaced.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. Alphanumeric identifiers for steps in method claims are for ease of reference in dependent claims and do not signify a required sequence unless otherwise stated.

What is claimed is:

1. A pallet assembly comprising:

a polymer upper deck;

a plurality of polymer supports extending downward from the upper deck, the plurality of supports including a first support, wherein the first support includes a front wall facing outward of the pallet; and a cap secured in front of the first support, the cap including a front panel facing outward of the pallet, the front panel positioned in front of the front wall; wherein the front panel includes a plurality of tabs protruding upward into apertures in the upper deck.

2. The pallet assembly of claim 1 wherein the cap interlocks with at least one of the first support and the upper deck.

3. The pallet assembly of claim 1 wherein the cap is formed of a polymer material.

4. The pallet assembly of claim 3 wherein the cap is made of a different material from the first support.

5. The pallet assembly of claim 4 wherein the cap material has a higher density than the material of the first support.

6. The pallet assembly of claim 1 further including a pair of curved side walls on either side of the front panel.

7. The pallet assembly of claim 1 further including a lower deck, the plurality of supports extending from the upper deck to the lower deck, the cap interlocking with the lower deck and the upper deck.

8. The pallet assembly of claim 7 wherein the plurality of supports are integrally molded with the lower deck.

9. The pallet assembly of claim 8 wherein the first support includes a front wall facing outward of the pallet, the front panel positioned in front of the front wall, the front panel including a plurality of projections slidably interlocking with the front wall.

10. The pallet assembly of claim 1 wherein the plurality of supports includes a pair of corner supports, the first support between the pair of corner supports.

11. A pallet support cap comprising:

a front panel generally disposed in a plane;

a pair of side walls extending rearward from outer edges of the front panel; and interlocking members projecting from at least one of the front panel and the side walls, the interlocking members include a first plurality of tabs projecting from the front panel in a first direction in the plane; wherein the side walls project forward of the plane of the front panel and open rearward.

12. The pallet support cap of claim 11 wherein the interlocking members further include a second plurality of tabs projecting from the front panel in a second direction opposite the first direction in the plane.

13. The pallet support cap of claim 12 wherein the interlocking members further include a pair of hooks projecting rearward from the support cap.

14. The pallet support cap of claim 11 wherein the side walls taper vertically from the front panel to a rearward edge.

15. A pallet assembly comprising:

an upper deck;

a plurality of plastic columns extending downward from the upper deck, the plurality of columns including a plurality of corner columns and an end column between two of the plurality of corner columns; and a cap secured in front of the end column, the cap including a front panel facing outward of the pallet in a first direction and interlocking with the upper deck such that the upper deck prevents the cap from moving in the first direction relative to the end column, the front panel made of a material different from the end column; wherein the front panel includes a plurality of tabs protruding upward into apertures in the upper deck.

16. The pallet assembly of claim 15 wherein the cap interlocks with the first support.

17. The pallet assembly of claim 15 wherein the cap is formed of a polymer.

18. The pallet assembly of claim 15 wherein the material of the cap has a higher density than material forming the end column.

19. The pallet assembly of claim 15 further including a lower deck, the plurality of columns extending from the upper deck to the lower deck, the cap interlocking with the lower deck and the upper deck.

20. The pallet assembly of claim 15 wherein the end column includes a front wall facing outward of the pallet, the front panel positioned in front of the front wall, the front panel slidably interlocking with the front wall.

21. A method for assembling a pallet including the steps of:

a) molding a plurality of columns;

b) molding a first deck integrally with the plurality of columns;

c) molding a second deck;

d) sliding a cap over one of the plurality of columns; and e) securing together the first deck, second deck, plurality of columns and cap; wherein the cap is slidably and interlockingly inserted onto the one column in a direction toward the first deck in said step d).

22. The method of claim 21 wherein said step d) is performed before at least part of said step e).

* * * * *